US009358170B2

(12) United States Patent
Jackson

(10) Patent No.: US 9,358,170 B2
(45) Date of Patent: Jun. 7, 2016

(54) SURGERY TABLE APPARATUS

(71) Applicant: Roger P Jackson, Prairie Village, KS (US)

(72) Inventor: Roger P Jackson, Prairie Village, KS (US)

( * ) Notice: Subject to any disclaimer, the term of this patent is extended or adjusted under 35 U.S.C. 154(b) by 0 days.

(21) Appl. No.: 14/195,326

(22) Filed: Mar. 3, 2014

(65) Prior Publication Data

US 2014/0173826 A1 Jun. 26, 2014

Related U.S. Application Data

(63) Continuation of application No. 13/694,765, filed on Jan. 2, 2013, now Pat. No. 8,677,529, which is a continuation of application No. 13/317,397, filed on Oct. 17, 2011, now abandoned, which is a continuation of application No. 12/803,252, filed on Jun. 22, 2010, now abandoned, and a continuation of application No. 12/288,516, filed on Oct. 20, 2008, now Pat. No. 7,739,762.

(60) Provisional application No. 60/960,933, filed on Oct. 22, 2007.

(51) Int. Cl.

| | |
|---|---|
| ***A61G 13/04*** | (2006.01) |
| ***A61G 13/08*** | (2006.01) |
| *A61G 13/00* | (2006.01) |

(52) U.S. Cl.

CPC ..... *A61G 13/08* (2013.01); *A61G 13/04* (2013.01); *A61G 2013/0054* (2013.01)

(58) Field of Classification Search

CPC ..... A61G 13/04; A61G 13/08
USPC ..... 5/600, 607, 610–613, 617–619, 624
See application file for complete search history.

(56) References Cited

U.S. PATENT DOCUMENTS

| | | | |
|---|---|---|---|
| 1,098,477 | A | 6/1914 | Cashman |
| 1,171,713 | A | 2/1916 | Gilkerson |
| 1,528,835 | A | 3/1925 | McCullough |
| 1,667,982 | A | 5/1928 | Pearson |
| 1,780,399 | A | 11/1930 | Munson |
| 1,799,692 | A | 4/1931 | Knott |
| 1,938,006 | A | 12/1933 | Blanchard |
| 2,188,592 | A | 1/1940 | Hosken et al. |

(Continued)

FOREIGN PATENT DOCUMENTS

| | | |
|---|---|---|
| CN | 2467091 Y | 12/2001 |
| GB | 569758 | 6/1945 |

(Continued)

OTHER PUBLICATIONS

Brochure of Smith & Nephew on Spinal Positioning System, 2003, 2004.

Complaint for Patent Infringement, *Jackson* v. *Mizuho Orthopedic Sys., Inc.*, No. 4:12-CV-01031 (W.D. Mo. Aug. 7, 2012).

First Amended Complaint for Patent Infringement and Correction of Inventorship, *Jackson* v. *Mizuho Orthopedic Sys., Inc.*, No. 4:12-CV-01031 (W.D. Mo. Sep. 21, 2012).

(Continued)

*Primary Examiner* — Fredrick Conley
(74) *Attorney, Agent, or Firm* — Polsinelli PC

(57) ABSTRACT

A surgery table utilizing first and second sections which are hingedly attached to one another. First and second sections are also connected to supports apart from the hinged portion. An elevator moves one of the sections upwardly and downwardly at the support. The resultant position of the frame formed by the first and second sections may take the configuration of a flat surface or an upwardly or downwardly oriented "vee".

20 Claims, 4 Drawing Sheets

(56) References Cited

U.S. PATENT DOCUMENTS 2,261,297 A 11/1941 Frederick
2,475,003 A 7/1949 Black
2,636,793 A 4/1953 Meyer
2,688,410 A 9/1954 Nelson
2,792,945 A 5/1957 Brenny
3,046,071 A 7/1962 Shampaine et al.
3,049,726 A 8/1962 Getz
3,281,141 A 10/1966 Smiley
3,584,321 A * 6/1971 Buchanan ..... 5/601
3,599,964 A 8/1971 Magni
3,766,384 A 10/1973 Anderson
3,814,414 A 6/1974 Chapa
3,832,742 A 9/1974 Stryker
3,988,790 A 11/1976 Mracek et al.
4,101,120 A 7/1978 Seshima
4,131,802 A 12/1978 Braden et al.
4,144,880 A 3/1979 Daniels
4,148,472 A 4/1979 Rais et al.
4,175,550 A 11/1979 Leininger et al.
4,186,917 A 2/1980 Rais et al.
4,227,269 A 10/1980 Johnston
4,230,100 A 10/1980 Moon
4,391,438 A 7/1983 Heffington, Jr.
4,474,364 A 10/1984 Brendgord
4,503,844 A 3/1985 Siczek
4,552,346 A 11/1985 Schnelle et al.
4,712,781 A 12/1987 Watanabe
4,718,077 A 1/1988 Moore et al.
4,763,643 A 8/1988 Vrzalik
4,771,785 A 9/1988 Duer
4,872,657 A 10/1989 Lussi
4,887,325 A 12/1989 Tesch
4,937,901 A 7/1990 Brennan
4,944,500 A 7/1990 Mueller et al.
4,953,245 A 9/1990 Jung
4,970,737 A 11/1990 Sagel
5,013,018 A 5/1991 Sicek et al.
5,088,706 A * 2/1992 Jackson ..... 5/608
5,131,105 A 7/1992 Harrawood et al.
5,131,106 A 7/1992 Jackson
5,161,267 A 11/1992 Smith
5,163,890 A * 11/1992 Perry, Jr. ..... 482/142
5,181,289 A 1/1993 Kassai
5,208,928 A 5/1993 Kuck et al.
5,210,887 A 5/1993 Kershaw
5,210,888 A 5/1993 Canfield
5,230,112 A 7/1993 Harrawood et al.
5,231,741 A 8/1993 Maguire
5,239,716 A 8/1993 Fisk
5,274,862 A 1/1994 Palmer, Jr. et al.
5,333,334 A 8/1994 Kassai
5,393,018 A 2/1995 Roth et al.
5,444,882 A 8/1995 Andrews et al.
5,461,740 A 10/1995 Pearson
5,468,216 A 11/1995 Johnson et al.
5,487,195 A 1/1996 Ray
5,499,408 A 3/1996 Nix
5,524,304 A 6/1996 Shutes
5,544,371 A 8/1996 Fuller
5,579,550 A 12/1996 Bathrick
5,588,705 A 12/1996 Chang
5,613,254 A 3/1997 Clayman et al.
5,640,730 A 6/1997 Godette
5,645,079 A 7/1997 Zahiri et al.
5,658,315 A 8/1997 Lamb et al.
5,659,909 A 8/1997 Pfeuffer et al.
5,673,443 A 10/1997 Marmor
5,737,781 A 4/1998 Votel
5,754,997 A 5/1998 Lussi et al.
5,774,914 A 7/1998 Johnson et al.
5,794,286 A 8/1998 Scott et al.
5,862,549 A 1/1999 Morton et al.
5,870,784 A 2/1999 Elliott
5,890,238 A 4/1999 Votel
5,901,388 A 5/1999 Cowan
5,937,456 A 8/1999 Norris
5,996,151 A 12/1999 Bartow et al.
6,000,076 A 12/1999 Webster et al.
6,035,465 A 3/2000 Rogozinski
6,049,923 A 4/2000 Ochiai
6,212,713 B1 4/2001 Kuck et al.
6,260,220 B1 7/2001 Lamb et al.
6,282,736 B1 9/2001 Hand et al.
6,282,738 B1 9/2001 Heimbrock et al.
6,286,164 B1 9/2001 Lamb et al.
6,295,671 B1 10/2001 Reesby et al.
6,322,251 B1 11/2001 Ballhaus et al.
6,438,777 B1 8/2002 Bender
6,496,991 B1 12/2002 Votel
6,499,162 B1 12/2002 Lu
6,505,365 B1 1/2003 Hanson et al.
6,526,610 B1 3/2003 Hand et al.
6,634,043 B2 10/2003 Lamb et al.
6,638,299 B2 10/2003 Cox
6,662,388 B2 12/2003 Friel
6,668,396 B2 12/2003 Wei
6,681,423 B2 1/2004 Zachrisson
6,701,553 B1 3/2004 Hand et al.
6,854,137 B2 2/2005 Johnson
6,857,144 B1 2/2005 Huang
6,862,759 B2 3/2005 Hand et al.
6,971,131 B2 12/2005 Bannister
6,971,997 B1 12/2005 Ryan et al.
7,003,828 B2 2/2006 Roussy
7,055,195 B2 6/2006 Roussy
7,089,612 B2 8/2006 Rocher et al.
7,103,931 B2 9/2006 Somasundaram et al.
7,137,160 B2 11/2006 Hand et al.
7,152,261 B2 12/2006 Jackson
7,189,214 B1 3/2007 Saunders
7,197,778 B2 4/2007 Sharps
7,290,302 B2 11/2007 Sharps
7,331,557 B2 2/2008 Dewert
7,343,635 B2 3/2008 Jackson
7,428,760 B2 9/2008 McCrimmon
7,565,708 B2 7/2009 Jackson
7,596,820 B2 10/2009 Nielsen et al.
7,653,953 B2 2/2010 Lopez-Sansalvador
7,669,262 B2 * 3/2010 Skripps et al. ..... 5/621
7,874,695 B2 1/2011 Jensen
8,060,960 B2 11/2011 Jackson
8,381,331 B2 2/2013 Sharps et al.
8,584,281 B2 11/2013 Diel et al.
8,677,529 B2 3/2014 Jackson
8,707,476 B2 4/2014 Sharps
8,707,484 B2 4/2014 Jackson et al.
8,719,979 B2 5/2014 Jackson
8,826,474 B2 9/2014 Jackson
8,826,475 B2 9/2014 Jackson
8,839,471 B2 9/2014 Jackson
8,844,077 B2 9/2014 Jackson et al.
8,856,986 B2 10/2014 Jackson
8,938,826 B2 1/2015 Jackson
8,978,180 B2 3/2015 Jackson
2001/0037524 A1 11/2001 Truwit
2004/0098804 A1 5/2004 Varadharajulu et al.
2004/0133983 A1 7/2004 Newkirk et al.
2006/0016010 A1 1/2006 Weismiller
2006/0123546 A1 6/2006 Horton et al.
2006/0185090 A1 8/2006 Jackson
2007/0107126 A1 5/2007 Koch et al.
2007/0169265 A1 7/2007 Saracen et al.
2007/0192960 A1 * 8/2007 Jackson ..... 5/618
2008/0000028 A1 1/2008 Lemire et al.
2009/0126116 A1 5/2009 Lamb et al.
2010/0192300 A1 8/2010 Tannoury et al.
2011/0099716 A1 5/2011 Jackson
2011/0107516 A1 5/2011 Jackson
2011/0107517 A1 5/2011 Lamb et al.
2012/0144589 A1 6/2012 Skripps et al.
2012/0198625 A1 8/2012 Jackson
2012/0246829 A1 10/2012 Lamb et al.
2012/0255122 A1 10/2012 Diel et al.
2013/0111666 A1 5/2013 Jackson

(56) References Cited

U.S. PATENT DOCUMENTS

| | | | |
|---|---|---|---|
| 2013/0133137 | A1 | 5/2013 | Jackson |
| 2013/0198958 | A1 | 8/2013 | Jackson et al. |
| 2013/0205500 | A1 | 8/2013 | Jackson |
| 2013/0219623 | A1 | 8/2013 | Jackson |
| 2013/0254992 | A1 | 10/2013 | Jackson |
| 2013/0254993 | A1 | 10/2013 | Jackson |
| 2013/0254994 | A1 | 10/2013 | Jackson |
| 2013/0254995 | A1 | 10/2013 | Jackson |
| 2013/0254996 | A1 | 10/2013 | Jackson |
| 2013/0254997 | A1 | 10/2013 | Jackson |
| 2013/0269710 | A1 | 10/2013 | Hight et al. |
| 2013/0312181 | A1 | 11/2013 | Jackson et al. |
| 2013/0312187 | A1 | 11/2013 | Jackson |
| 2013/0318718 | A1 | 12/2013 | Jackson |
| 2013/0318719 | A1 | 12/2013 | Jackson |
| 2013/0326812 | A1 | 12/2013 | Jackson |
| 2013/0326813 | A1 | 12/2013 | Jackson |
| 2014/0007349 | A1 | 1/2014 | Jackson |
| 2014/0020181 | A1 | 1/2014 | Jackson |
| 2014/0033436 | A1 | 2/2014 | Jackson |
| 2014/0068861 | A1 | 3/2014 | Jackson et al. |
| 2014/0082842 | A1 | 3/2014 | Jackson |
| 2014/0109316 | A1 | 4/2014 | Jackson et al. |
| 2014/0196212 | A1 | 7/2014 | Jackson |
| 2014/0201913 | A1 | 7/2014 | Jackson |
| 2014/0201914 | A1 | 7/2014 | Jackson |
| 2014/0208512 | A1 | 7/2014 | Jackson |
| 2014/0317847 | A1 | 10/2014 | Jackson |
| 2015/0059094 | A1 | 3/2015 | Jackson |
| 2015/0150743 | A1 | 6/2015 | Jackson |

FOREIGN PATENT DOCUMENTS

| | | | |
|---|---|---|---|
| GB | 810956 | | 3/1959 |
| JP | S53763 | | 1/1978 |
| JP | 2000060995 | | 2/2000 |
| WO | 9907320 | | 2/1999 |
| WO | 0062731 | | 10/2000 |
| WO | 0160308 | | 8/2001 |
| WO | 03070145 | | 8/2003 |
| WO | WO 2007/130679 | A2 | 11/2007 |
| WO | 2009054969 | | 4/2009 |
| WO | 2009100692 | | 8/2009 |
| WO | WO2010/051303 | A1 | 5/2010 |

OTHER PUBLICATIONS

Defendant Mizuho Orthopedic Systems, Inc.'s Answer to First Amended Complaint and Counterclaims, *Jackson* v. *Mizuho Orthopedic Sys., Inc.*, No. 4:12-CV-01031 (W.D. Mo. Nov. 1, 2012).

Plaintiff Roger P. Jackson, MD's, Reply to Counterclaims, *Jackson* v. *Mizuho Orthopedic Sys., Inc.*, No. 4:12-CV-01031 (W.D. Mo. Nov. 26, 2012).

Roger P. Jackson's Disclosure of Asserted Claims and Preliminary Infringement Contentions, *Jackson* v. *Mizuho Orthopedic Sys., Inc.*, No. 4:12-CV-01031 (W.D. Mo. Jan. 4, 2013).

Second Amended Complaint for Patent Infringement, for Correction of Inventorship, for Breach of a Non-Disclosure and Confidentiality Agreement, and for Misappropriation of Dr. Jackson's Right of Publicity, *Jackson* v. *Mizuho Orthopedic Sys., Inc.*, No. 4:12-CV-01031 (W.D. Mo. Jan. 28, 2013).

Defendant Mizuho Orthopedic Systems, Inc.'s Answer to Second Amended Complaint and Counterclaims, *Jackson* v. *Mizuho Orthopedic Sys., Inc.*, No. 4:12-CV-01031 (W.D. Mo. Feb. 19, 2013).

Defendant Mizuho Osi's Invalidity Contentions Pursuant to the Parties' Joint Scheduling Order, *Jackson* v. *Mizuho Orthopedic Sys., Inc.*, No. 4:12-CV-01031 (W.D. Mo. Feb. 22, 2013).

Plaintiff Roger P. Jackson, MD's, Reply to Second Counterclaims, *Jackson* v. *Mizuho Orthopedic Sys., Inc.*, No. 4:12-CV-01031 (W.D. Mo. Mar. 12, 2013).

Roger P. Jackson, MD's Disclosure of Proposed Terms to Be Construed, *Jackson* v. *Mizuho Orthopedic Sys., Inc.*, No. 4:12-CV-01031 (W.D. Mo. Apr. 5, 2013).

Defendant Mizuho Orthopedic Systems, Inc.'s Disclosure of Proposed Terms and Claim Elements for Construction, *Jackson* v. *Mizuho Orthopedic Sys., Inc.*, No. 4:12-CV-01031 (W.D. Mo. Apr. 5, 2013).

Mizuho Orthopedic Systems, Inc.'s Disclosure of Proposed Claim Constructions and Extrinsic Evidence, *Jackson* v. *Mizuho Orthopedic Sys., Inc.*, No. 4:12-CV-01031 (W.D. Mo. May 13, 2013).

Plaintiff Roger P. Jackson, MD's Disclosure of Preliminary Proposed Claim Constructions, *Jackson* v. *Mizuho Orthopedic Sys., Inc.*, No. 4:12-CV-01031 (W.D. Mo. May 13, 2013).

Defendant Mizuho Osi's Amended Invalidity Contentions Pursuant to the Parties' Joint Scheduling Order, *Jackson* v. *Mizuho Orthopedic Sys., Inc.*, No. 4:12-CV-01031 (W.D. Mo. May 15, 2013).

Joint Claim Construction Chart and Joint Prehearing Statement, *Jackson* v. *Mizuho Orthopedic Sys., Inc.*, No. 4:12-CV-01031 (W.D. Mo. Jun. 7, 2013).

Defendant Mizuho Orthopedic Systems, Inc.'s Objections and Responses to Plaintiff's First Set of Interrogatories, *Jackson* v. *Mizuho Orthopedic Sys., Inc.*, No. 4:12-CV-01031 (W.D. Mo. Jun. 24, 2013).

Defendant Mizuho Orthopedic Systems, Inc.'s Opening Claim Construction Brief, *Jackson* v. *Mizuho Orthopedic Sys., Inc.*, No. 4:12-CV-01031 (W.D. Mo. Jul. 31, 2013).

Plaintiff Roger P. Jackson, MD's Opening Claim Construction Brief, *Jackson* v. *Mizuho Orthopedic Sys., Inc.*, No. 4:12-CV-01031 (W.D. Mo. Jul. 31, 2013).

Appendix A Amended Infringement Contentions Claim Chart for Mizuho's Axis System Compared to U.S. Patent No. 7,565,708, *Jackson* v. *Mizuho Orthopedic Sys., Inc.*, No. 4:12-CV-01031 (W.D. Mo. Aug. 12, 2013).

Appendix B Amended Infringement Contentions Claim Chart for Mizuho's Axis System Compared to U.S. Patent No. 8,060,960, *Jackson* v. *Mizuho Orthopedic Sys., Inc.*, No. 4:12-CV-01031 (W.D. Mo. Aug. 12, 2013).

Appendix C Amended Infringement Contentions Claim Chart for Mizuho's Proaxis System Compared to U.S. Patent No. 7,565,708, *Jackson* v. *Mizuho Orthopedic Sys., Inc.*, No. 4:12-CV-01031 (W.D. Mo. Aug. 12, 2013).

Appendix D Amended Infringement Contentions Claim Chart for Mizuho's Proaxis System Compared to U.S. Patent No. 8,060,960, *Jackson* v. *Mizuho Orthopedic Sys., Inc.*, No. 4:12-CV-01031 (W.D. Mo. Aug. 12, 2013).

Plaintiff Roger P. Jackson, MD's Responsive Claim Construction Brief, *Jackson* v. *Mizuho Orthopedic Sys., Inc.*, No. 4:12-CV-01031 (W.D. Mo. Aug. 16, 2013).

Defendant Mizuho Orthopedic Systems, Inc's Brief in Response to Plaintiffs Opening Claim Construction Brief, *Jackson* v. *Mizuho Orthopedic Sys., Inc.*, No. 4:12-CV-01031 (W.D. Mo. Aug. 16, 2013).

Plaintiff Roger P. Jackson, MD's Suggestions in Support of His Motion to Strike Exhibit A of Mizuho's Opening Claim Construction Brief, *Jackson* v. *Mizuho Orthopedic Sys., Inc.*, No. 4:12-CV-01031 (W.D. Mo. Aug. 16, 2013).

Defendant Mizuho Orthopedic Systems, Inc.'s Opposition to Plaintiff's Motion to Strike, *Jackson* v. *Mizuho Orthopedic Sys., Inc.*, No. 4:12-CV-01031 (W.D. Mo. Sep. 3, 2013).

Transcript of Claim Construction Hearing, *Jackson* v. *Mizuho Orthopedic Sys., Inc.*, No. 4:12-CV-01031 (W.D. Mo. Oct. 11, 2013).

Plaintiff Roger P. Jackson, MD's Claim Construction Presentation for U.S. District Judge Nanette K. Laughrey, *Jackson* v. *Mizuho Orthopedic Sys., Inc.* 4:12-CV-01031 (W.D. Mo. Oct. 11, 2013).

Mizuho's Claim Construction Argument, *Jackson* v. *Mizuho Orthopedic Sys., Inc.*, No. 4:12-CV-01031 (W.D. Mo. Oct. 11, 2013).

Order, *Jackson* v. *Mizuho Orthopedic Sys., Inc.*, No. 4:12-CV-01031 (W.D. Mo. Apr. 4, 2014).

Canadian Office Action, CA2803110, dated Mar. 5, 2015.

Chinese Office Action, CN 201180039162.0, dated Jan. 19, 2015.

European Search Report, EP11798501.0, dated Mar. 30, 2015.

Japanese Office Action, JP 2014-132463, dated Jun. 18, 2015.

Japanese Office Action, JP 2014-142074, dated Jun. 18, 2015.

* cited by examiner

SURGERY TABLE APPARATUS

CROSS REFERENCE TO RELATED APPLICATIONS

The present application is a Continuation of U.S. patent application Ser. No. 13/694,765, filed Jan. 2, 2013 which was a Continuation of U.S. patent application Ser. No. 13/317,397, filed Oct. 17, 2011, both of which are incorporated by reference herein. Application Ser. No. 13/317,397 was a Continuation of U.S. patent application Ser. No. 12/803,252, filed Jun. 22, 2010. Application Ser. No. 13/317,397 was also a Continuation of U.S. patent application Ser. No. 12/288,516, filed Oct. 20, 2008, now U.S. Pat. No. 7,739,762, issued Jun. 22, 2010, that claimed the benefit of U.S. Provisional Patent Application 60/960,933, filed Oct. 22, 2007, all of which are incorporated by reference herein.

BACKGROUND OF THE INVENTION

The present invention relates to a novel and useful surgery table.

Surgery practices require the support of a patient on a surgery table and the adjustment of the patient's body by movements that include tilting, raising and lowering. Also articulation of the patient's body, generally around the waist portion may be necessary in certain instances. In the past, such movements have been achieved by the use of supports such as pillows and pads that are placed beneath and around the patient by surgical workers.

In addition, specialized motor-driven surgery tables have been devised to create a multiplicity of positions of a supporting surface to orient the patient resting atop the same. For example, U.S. Pat. No. 6,634,043 describes a medical table which includes a head portion and a pair of foot columns, all of which are extendable and retractable between upper and lower positions for maneuvering a patient to achieve proper support.

U.S. Pat. No. 7,152,261 describes a modular support system which is usable for surgery in which a pair of supports are independently operated adjacent one another to provide a plurality of support position for a patient.

A surgery table which allows the articulation of a pair of sections in order to position a patient for surgery in a safe and efficient manner would be a notable advance in the medical field.

BRIEF SUMMARY OF THE INVENTION

In accordance with the present invention a novel and useful surgery table is herein provided.

The surgery of the present application includes a first section having a proximal end and a distal end. A second section is also included and possesses a proximal and distal end. The distal ends of the first and second sections are hingedly attached to one another to form a frame that supports a patient for carrying out surgical procedures.

A first support holds the proximal end of the first section. The first support also includes an elevator which allows the proximal end portion of the first section to move relative to the first support. A second support holds the proximal end of the second section and includes a pivot to allow the hinging of the first section relative to the second section upon movement of the elevator found in the first support.

A length compensation mechanism is also present in relation to the first section to provide an adjustment of the distance between the proximal portion of the first section relative to the first support. Such length compensation may take the form of a journaled shaft which is positioned intermediate the first section and the first support. Further, another hinge may lie between the journal and the first support to provide articulation as required.

An upper body support may also be formed on the frame formed by the first and second sections. Such upper body support may include a slidable platform which allows the gentle movement of the patient when the frame is hinged to form an angle between the first and second sections thereof. Such upper body support may take the form of a flattened member which is moved by a belt or a chain and sprocket mechanism.

Further, the surgery table of the present invention may include a roll drive which allows the tilting of the frame along an axis common to the first and second supports. Again, the roll drive permits the surgeon to perform medical procedures in a convenient and safe manner due to such positioning of the patient.

The frame, as well as the first and second supports, may be interlinked by a bar which provides stability and adjustability to the length of the surgery table. Wheels may also be provided on the first and second supports to allow the surgery table be easily moved from storage to an operating room and back again.

It may be apparent that a novel and useful surgery table has been hereinabove described.

It is therefore an object of the present invention to provide a surgery table which is capable of positioning a patient for surgery procedures in a variety of positions.

Another object of the present invention is to provide a surgery table which is capable of positioning a patient for surgical procedures which eliminates frictional dragging of the patient relative to the surgery table.

Another object of the present invention is to provide a surgery table which is capable of positioning a patient in an angulated position in order to allow a surgeon to perform back surgery.

Another object of the present invention is to provide a surgery table which is capable of positioning a patient in a variety of surgical positions through a motorized mechanism, thus maximizing patient comfort and safety.

A further object of the present invention is to provide a surgery table which permits the use of X-ray devices during surgical procedures.

Another object of the present invention is to provide a surgery table which eliminates pinch points on the patient while the patient is being maneuvered into surgical positions.

A further object of the present invention is to provide a surgery table which is simple, compact, and easy to use during positioning of a patient for surgical procedures.

Yet another object of the present invention is to provide a surgery table which effects harmonious translation of the patient's torso during intraoperative spinal flexion and extension.

Another object of the present invention is to provide a surgery table that includes mechanisms to prevent distraction and compression of the spine of a patient when such patient is positioned for surgical procedures.

Another object of the present invention is to provide a surgery table which supports the natural biomechanics of the spine.

A further object of the present invention is to provide a surgery table that improves surgical access and visualization at a surgical site.

Another object of the present invention is to provide a surgery table that facilitates closure during lumbar osteotomy surgery.

Yet another object of the present invention is to provide a surgery table that employs a two-part hinged structure to enhance prone supine, and lateral procedures.

A further object of the present invention is to provide a surgery table that reduces renal caval compression and minimizes epidural venous bleeding.

The invention possesses other objects and advantages especially as concerns particular characteristics and features thereof which will become apparent as specification continues.

Figure 1:
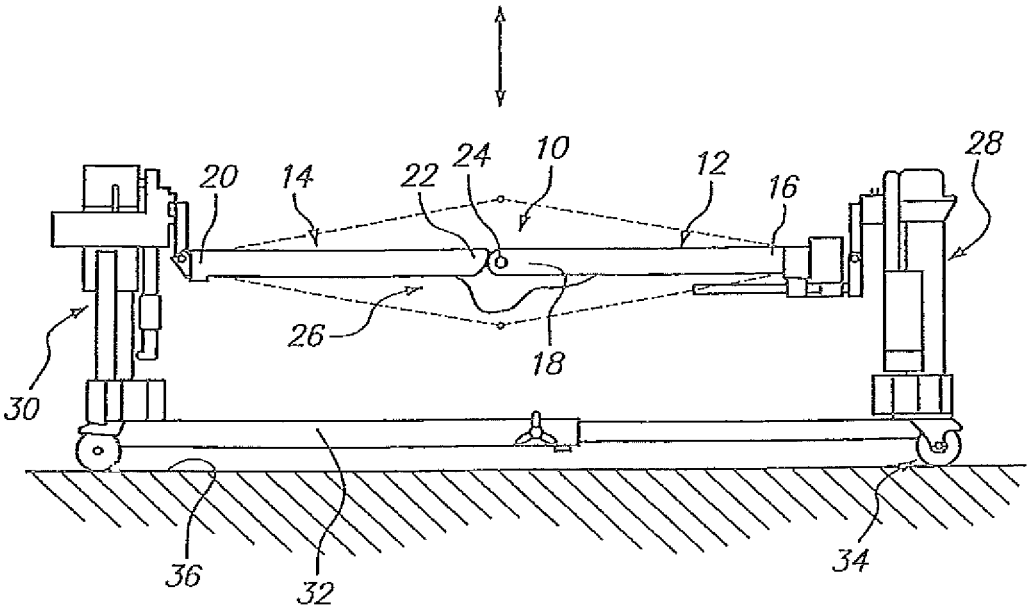
FIG. 1 is a side elevational view of the surgery table of the present invention.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior described drawings.

An embodiment of the invention as a whole shown in the drawings by reference character 10. Table 10 includes as two of its elements a first section 12 and a second section 14. First section 12 includes a proximal portion 16 and a distal portion 18. Likewise, second section 14 is provided with a proximal portion 20 and a distal portion 22. Hinge 24 rotatably connects distal portion 18 of first section 12 to distal portion 22 of second section 14, FIG. 1. First section 12, second section 14, and hinge 24 form a frame 26 which is intended to support a patient during surgery.

Again referring to FIG. 1, it may be observed that a first support 28 holds proximal portion 16 of first section 12, while a second support 30 holds proximal portion 20 of second section 14. Adjustable rod member 32 further stabilizes the interconnection between first support 28 and second support 30. Plurality of wheels 34 allow surgery table 10 to roll on a surface 36. Such mobility is necessary for storage and use of surgery table 12. Of course, wheels 34 may be locked into place while surgery table is used for medical procedures.

Figure 2:
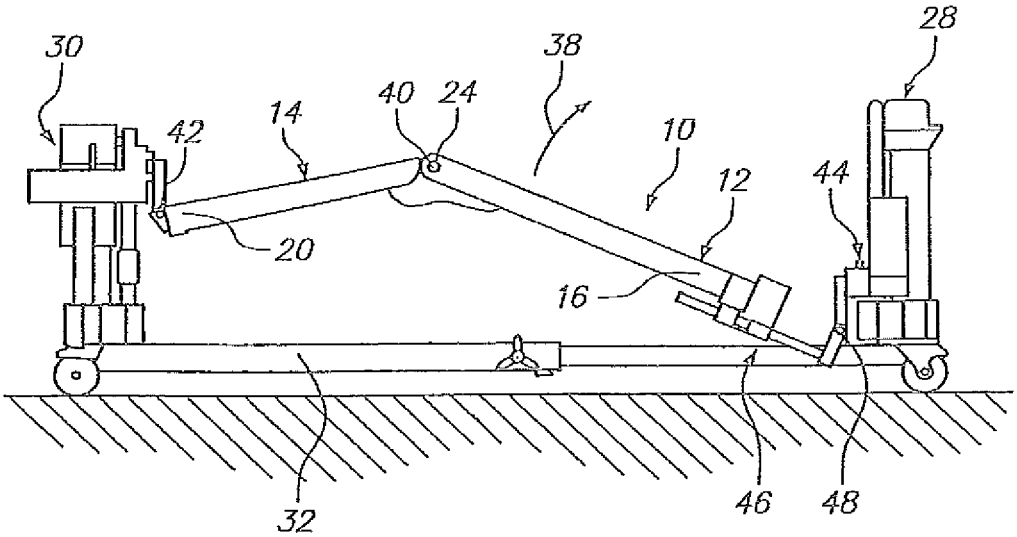
FIG. 2 is a side elevational view of the surgery table of the present invention angulated upwardly through its hinge mechanism to position a patient for back surgery.

Turning to FIG. 2, it may be seen that first section 12 has been rotated relative to second section 14, directional arrow 38. FIG. 1, depicts the up and down movement of distal ends 18 and 22 in phantom. During this operation, hinge 24 rotates about axis 40 and the proximal portion of second section 14 rotates about pivot 42. Additionally, an elevator 44 lowers the proximal portion 16 of first section 12. Adjustor 46, in the form of a journaled shaft, determines the distance between proximal portion 16 of first section 12 and support 28. Further, pivot 48 allows the rotation of a portion of adjustor 46 relative to elevator 44. Elevator 44 may be of known configuration, similar to one found in the Jackson surgery table distributed by Mizuho Orthopedic Systems Inc of Union City, Calif.

Figure 7:
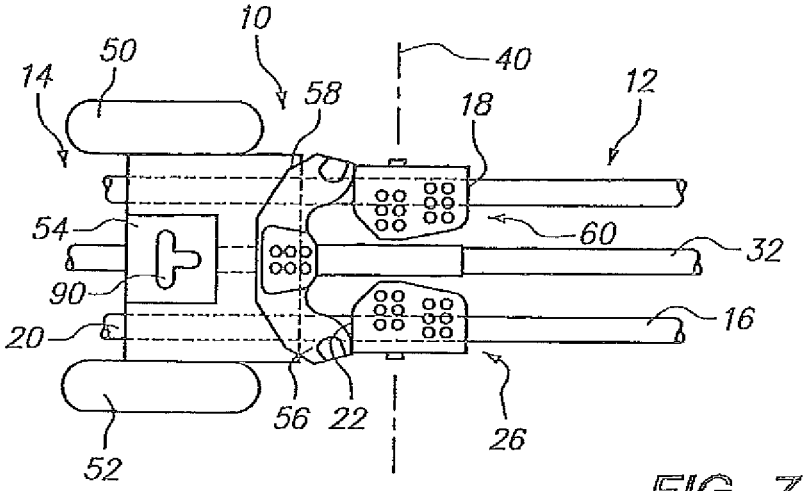
FIG. 7 is a partial top plan view of the surgery table of the FIG. 1 showing the face pad, chest pad, hip pads, and arm rests, and slidable platform.

With respect to FIG. 7, it may be apparent that surgery table 10 includes a number of patient support items. For example, arm rests 50 and 52 extend to second section 14 for support therefrom. Face support 54 and chest support 56 lie on a platform 58 which slides along second section 14 of frame 26, the details of which will be discussed hereinafter. Hip supports 60 position atop first section 12. Other pads atop frame 26 have not been shown for the sake of clarity.

Figure 3:
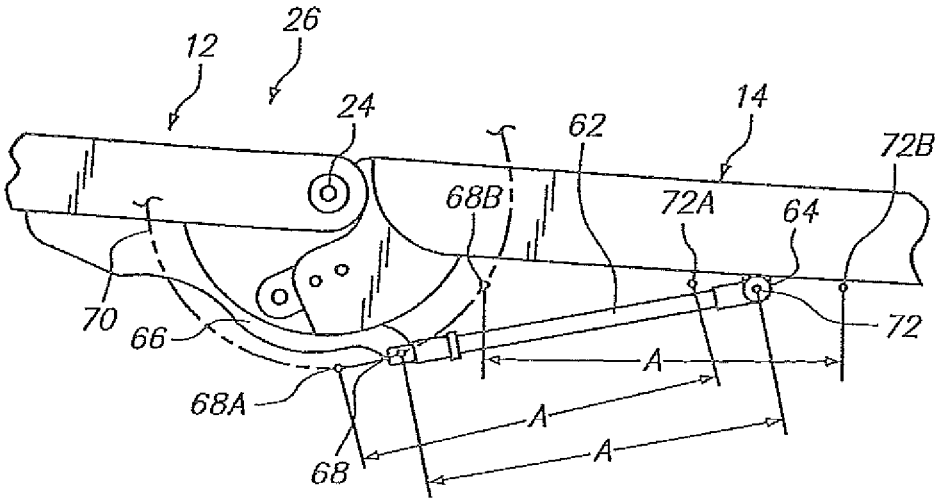
FIG. 3 is a partial side elevational view of the hinged portion of the table of the present invention, reversed in placement from FIGS. 1 and 2.

With reference to FIG. 3, it should be apparent that the hinged structure 24 of the table 10 is shown with portions of sections 12 and 14 shown on FIGS. 1 and 2. Hinge 24 is employed with a control rod 62 that is pivotally attached to tab 64 of first section 12 and to tab 66 of second section 14. When first and second sections 12 and 14 hinge downwardly, forming an upward vee, connection point 68 of control rod moves along arc 70 to a point 68A. At the same time, connection point 72 on the end of control rod at tab 64 moves to a point 72A. Likewise, when sections 12 and 14 hinge upwardly to form an upside down vee, connection point 68 moves along are 70 to a position identified as 68B, while position point 72 relative to section 12 moves to a point shown as 72B. Most importantly, the distances between points 68 and 72, 68A and 72A, and 68B and 72B remain the same, being identified as distance "A", FIG. 3.

Figure 4:
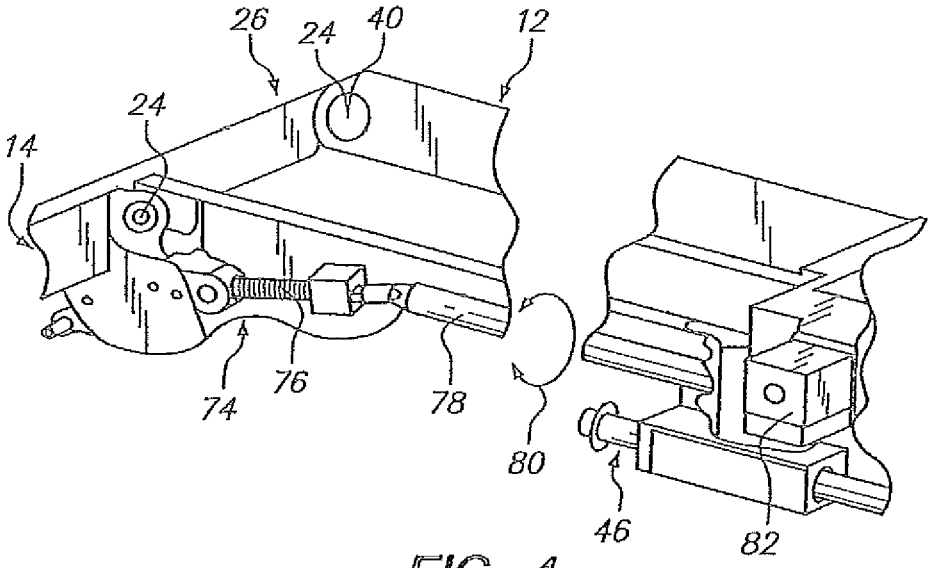
FIG. 4 is a broken perspective view of the hinge adjustment mechanism of the present invention.

Referring now to FIG. 4, it may be observed that the drive mechanism 74 is revealed in broken away configuration for the movement of sections 12 and 14. In essence, a lead screw 76 is rotated via link rod 78 according to directional arrow 80. Motor 82 provides the motivational force for such movement in a clockwise or a counter clockwise direction of link rod and lead screw 76. As depicted in FIG. 4, lead screw 76 has been turned to move frame 26 upwardly into an inverted vee position.

Figure 5:
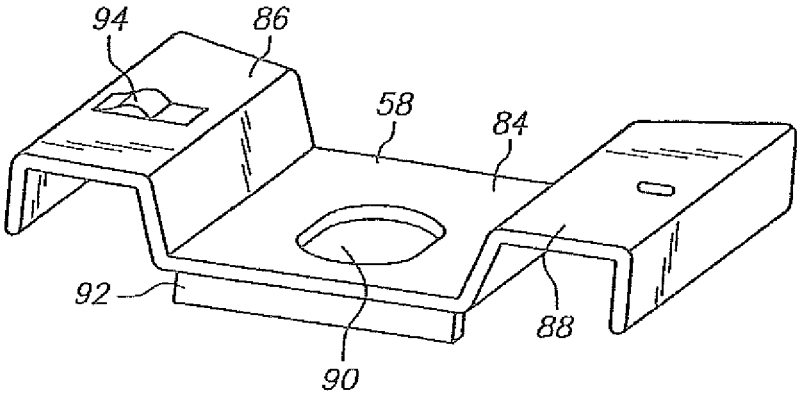
FIG. 5 is a top, front, right perspective view of the slidable platform for supporting the torso or chest of a patient used with the hinged sections of the table of the present invention.
Figure 6:
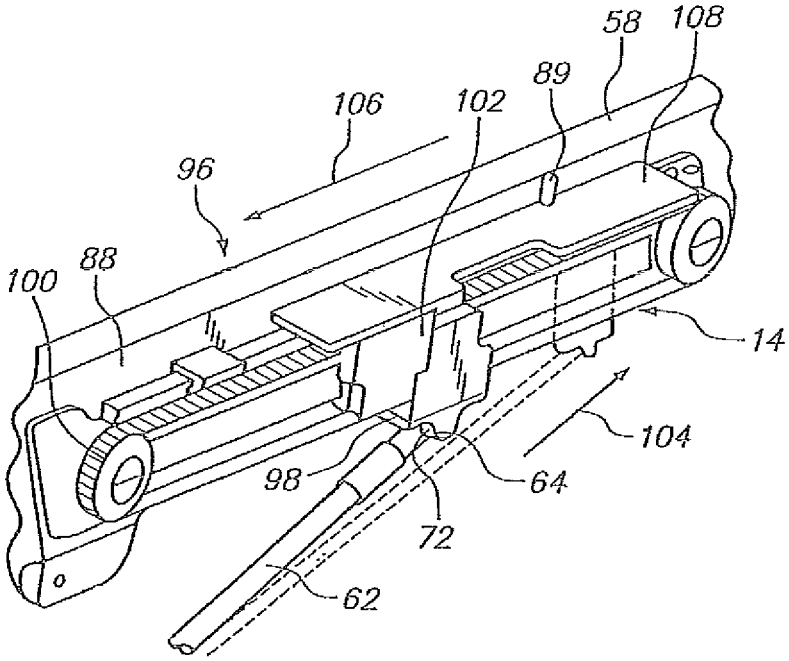
FIG. 6 is partial perspective view of the mechanism employed for sliding the torso platform of the present invention.

Turning now to FIGS. 5 and 6, it may be apparent that chest or torso sliding platform 58 is depicted. Platform 58 includes a central portion 84 and upwardly extending arms 86 and 88. Central opening 90 lies below the face of a patient when platform 58 is placed atop frame 26, FIG. 7. Plate 92 aides in the mounting of platform 58 to frame 26. Lock fixture 94 stabilizes platform 58 atop of frame 26.

FIG. 6, depicts the sliding mechanism 96 which moves platform 58 commensurate with the hinging of sections of 14 and 12 heretofore described. A plate 98, connected to control rod 62, captures a timing belt 100 in conjunction with a link 102. Thus, the movement of control rod connection point 72, directional arrow 104, moves belt 100 according to directional arrow 106. Needless to say, drive plate 108 also moves according to directional arrow 106 and is connected to sliding platform 58 at arm 88 via drive pin 89. In other words, the movement of connection point 72 of control rod 62 in one direction causes the movement of sliding platform 58 in the opposite direction.

Figure 8:
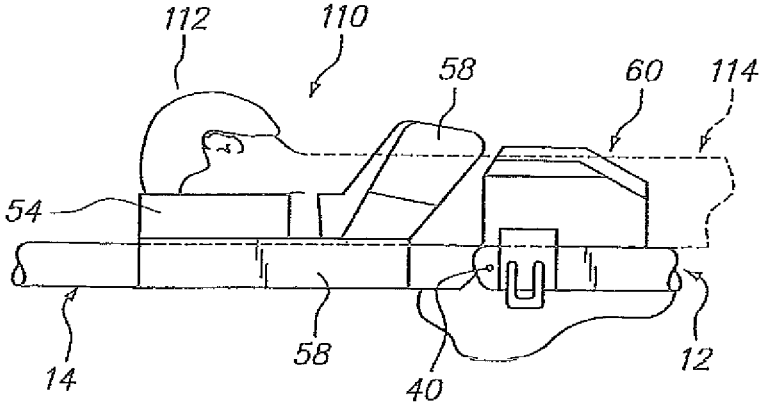
FIG. 8 is a schematic side elevational view of a portion of the surgery table of the present invention in which both sections are in the same plane.
Figure 9:
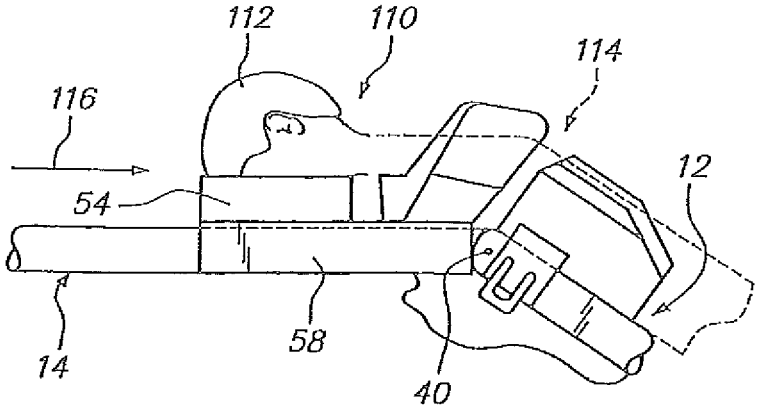
FIG. 9 is a side elevational view of a portion of the surgery table showing upward articulation of the same through its hinge mechanism and the movement of the face and torso support during such articulation.

In operation, referencing FIGS. 7-9, platform 58 is placed upon frame 26 and allowed to slide thereupon when sections 12 and 14 move about hinge 24 and around axis 40. In addition, face support 54, usually constructed of soft foam material, is positioned on sliding platform 58 above opening 90 chest support 56. Hip supports 60 are also placed as shown in FIG. 7. In addition, other pads may lie atop of frame 26 which are not depicted in order to reveal the mechanical mechanism of table 10. With reference to FIG. 8, it may be observed that a patient 110 has been placed on table 10 in a prone position. Head 112 lies atop of face support 54 while the remaining portion of patients body 114 extends toward first section 12 of frame 26. As shown in FIG. 8, the patient is generally in a level position. The hinging or movement of section 14 relative to section 12, FIG. 9, causes the upward movement of frame 26 in the formation of a inverted vee which allows patient 110 to be position appropriately for the conducting of operation procedures such as back surgery and the like. It should also be noted that sliding platform 58 and face support 54 has moved according to directional arrow 116 toward hinge axis 40 to prevent the frictional dragging of patient 110 relative to table 10. It should also be realized that patient 110 may be placed on table 10 laterally, in a supine position and the like. Of course, the hinging of table 10 about axis 40 would be accomplished in conjunction with such variations and positions of patient 110 pursuant to the surgical procedure taking place on patient 110. That is to say, distal portions 18 and 22 of first and second sections of frame 26 may raise or lower from a level position as required directional arrow 118, FIG. 2.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed and desired to be secured by Letters Patent is as follows:

1. A patient support apparatus for supporting a patient during a medical procedure, the apparatus comprising:

a) a patient support structure consisting of first and second open frame sections and a hinge, the first and second frame sections coupled at outer ends to supports and coupled at inner ends to the hinge;

b) a chest platform slidingly mounted on the first open frame section for receiving an upper portion of the patient, wherein the chest platform is prevented from freely sliding on the first open frame section and is configured to slide only when the first and second frame sections articulate about the hinge, c) a chest support coupled to the chest platform; and d) a hip support coupled to the second open frame section.

2. The patient support apparatus of claim 1, wherein the hinge comprises a pair of spaced apart hinges.

3. The patient support apparatus of claim 1, wherein the chest platform is prevented from freely sliding via a motivating mechanism.

4. The patient support apparatus of claim 3, wherein the motivating mechanism causes the chest platform to slide towards the hinge when the hinge articulates so as to position the patient in flexion.

5. The patient support apparatus of claim 4, wherein, when the patient is positioned in flexion, the first and second open frame sections define an upside-down vee with the pair of spaced apart hinges at an apex of the upside-down vee.

6. The patient support structure of claim 4, wherein, when the patient is positioned in flexion, an angle less than about 180 degrees is defined on an underside of the patient support apparatus between the first and second open frame sections.

7. The patient support apparatus of claim 1, wherein the patient support apparatus includes only a single axis of articulation between the outer ends of the first and second open frame sections.

8. In a patient support apparatus for supporting a patient during a medical procedure having first and second open frame sections that are inwardly connected by a pair of spaced apart hinges and outwardly held by supports; the improvement comprising:

a) a chest platform slidingly mounted on the first open frame section for receiving an upper portion of the patient, wherein a motivating mechanism causes sliding of the chest platform to coincide with articulating of the pair of spaced apart hinges, b) a chest support connected on the chest platform; and c) a hip support on the second open frame section.

9. The patient support apparatus of claim 8, wherein the patient support apparatus includes only a single axis of articulation between outer ends of the first and second open frame sections.

10. The patient support apparatus of claim 9, wherein the single axis of articulation extends through the pair of spaced apart hinges.

11. The patient support apparatus of claim 8, wherein the motivating mechanism causes the chest platform to slide towards the pair of spaced apart hinges when the pair of spaced apart hinges articulates so as to decrease an underside angle between the first and second open frame sections.

12. The patient support apparatus of claim 11, wherein the underside angle is defined on a side of the first and second open frame sections that is opposite the chest and hip supports.

13. The patient support apparatus of claim 8, further comprising a head support, the head support positioned above the chest support and connected on the chest platform.

14. The patient support apparatus of claim 8, further comprising a pair of arm rests that extend from the first open frame section for support therefrom, and that are connected to the chest platform.

15. The patient support apparatus of claim 8, wherein the motivating mechanism prevents the chest platform from freely sliding on the first open frame section.

16. The patient support apparatus of claim 8, wherein the hip support comprises a pad, and wherein a portion of the pad slopes downwardly toward the second frame section in a direction away from the hinges.

17. The patient support apparatus of claim 8, wherein the first and second open frame sections are inwardly connected by only a single pair of spaced apart hinges.

18. The patient support apparatus of claim 8, wherein the motivating mechanism causes the chest platform to slide towards the pair of spaced apart hinges when the pair of spaced apart hinges articulates so as to increasingly position the patient in flexion.

19. The patient support apparatus of claim 18, wherein, when the patient is positioned in flexion, the first and second open frame sections define an upside-down vee with the pair of spaced apart hinges at an apex of the upside-down vee.

20. The patient support structure of claim 18, wherein, when the patient is positioned in flexion, an angle less than about 180 degrees is defined on an underside of the patient support apparatus between the first and second open frame sections.

* * * * *